US006525452B1

(12) United States Patent
Guinard

(10) Patent No.: US 6,525,452 B1
(45) Date of Patent: Feb. 25, 2003

(54) LAMP WITH FILAMENT SEGMENTS IN CURVED LAYERS

(75) Inventor: Rémi Guinard, Nancy (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 49 days.

(21) Appl. No.: 09/593,915

(22) Filed: Jun. 14, 2000

(30) Foreign Application Priority Data

Jun. 15, 1999 (FR) ..... 99 07562

(51) Int. Cl.[7] ..... H01J 1/88; H01J 19/42; H01J 1/96; H01K 1/18

(52) U.S. Cl. ..... 313/272; 313/274; 313/273

(58) Field of Search ..... 313/271, 316, 313/273, 272; 362/296

(56) References Cited

U.S. PATENT DOCUMENTS 4,766,339 A * 8/1988 Berry et al. ..... 313/273
5,235,499 A * 8/1993 Bertenshaw ..... 313/578
5,268,613 A * 12/1993 Cunningham ..... 313/113

* cited by examiner

*Primary Examiner*—Vip Patel
*Assistant Examiner*—Matt Hodges
(74) *Attorney, Agent, or Firm*—Dicran Halajian; Frank J. Keegan

(57) ABSTRACT

An incandescent lamp has a filament formed by a plurality of filament segments. Each segment is formed by a straight coil section. The segments are mutually parallel and arranged in several layers. A first layer of filament segments is arranged along a first curved surface, and a second layer of filament segments is arranged along a second curved surface. The two curved surfaces are symmetrical with respect to a plane.

16 Claims, 2 Drawing Sheets

LAMP WITH FILAMENT SEGMENTS IN CURVED LAYERS

BACKGROUND OF THE INVENTION

The invention relates to an incandescent lamp comprising a filament formed by a plurality of filament segments, each segment consisting of a straight spiral section, said segments being mutually parallel and arranged in several layers.

A lamp as described in the opening paragraph is known from the document U.S. Pat No. 5,268,613. According to this document, a lamp placed in a reflector which is a body of revolution comprises a plurality of rectilinear helically coiled filament segments, arranged in two layers such that the filament segments are placed so as to be substantially equidistant to the axis of revolution of the reflector.

SUMMARY OF THE INVENTION

It is an object of the invention to provide better characteristics for the light beam, both in the case of a concentrated beam and in the case of a wide beam.

To achieve this, the straight filaments of a layer are disposed along a virtual involute curved surface within a layer of filament segments. The term "involute" is used in this specification to refer to a segment of an involute curve, rather than to the complete cross-section of an involute.

Special embodiments of the invention are defined in the dependent claims 2 to 8.

These as well as other, more detailed aspects of the invention will become clear from the following description of an embodiment, which is given by way of non-limitative example.

DETAILED DESCRIPTION OF THE PREFERRED EMBODIMENTS

Figure 1:
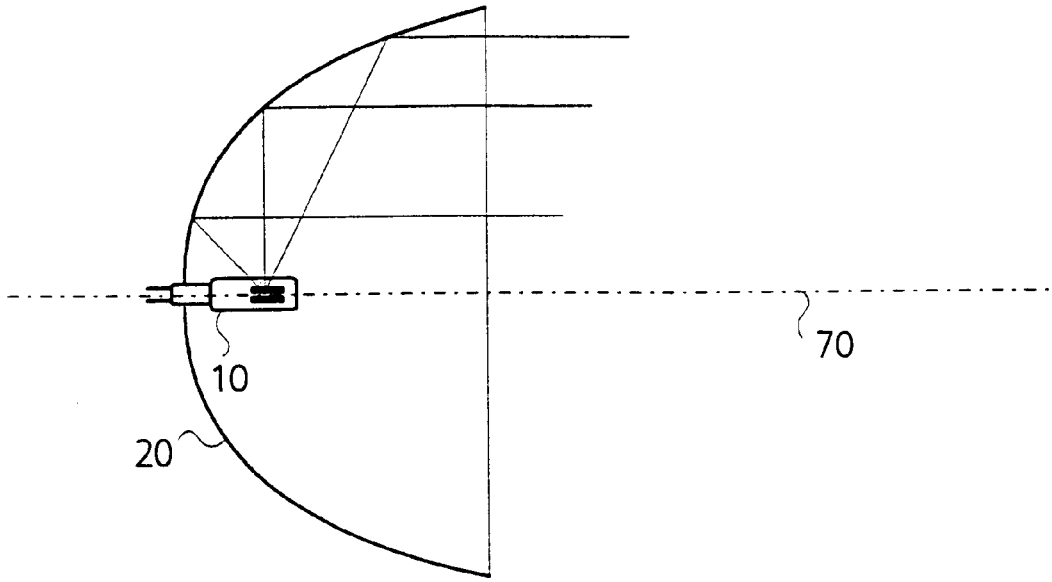
FIG. 1 shows a lamp in a reflector in cross-section, with its filament centered in the reflector and parallel to the reflector axis.

In FIG. 1, a lamp 10 is seen placed in a reflector 20, for example a parabolic body of revolution, with an axis of revolution 70. The lamp is positioned substantially at the optical focus of this reflector, and the filament segments are arranged parallel to the reflector axis.

Figure 2:
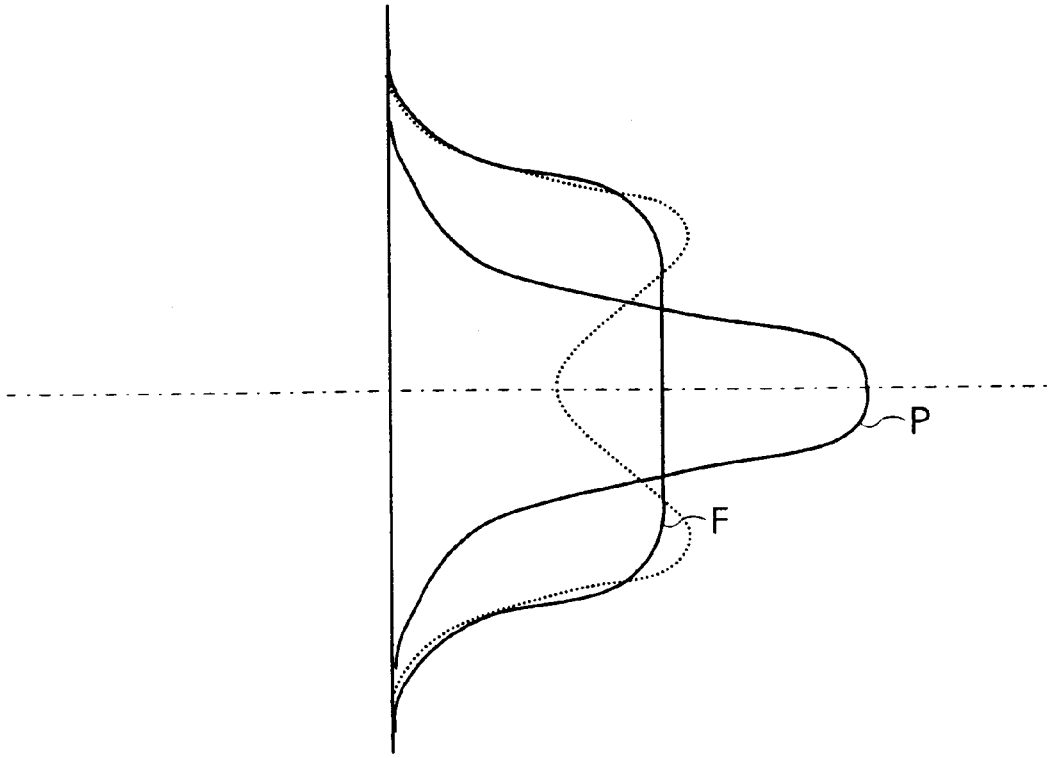
FIG. 2 shows desired illumination diagrams for the lamp/reflector assembly.

Different illumination types are desired depending on the application of the lamp/reflector assembly; the type of illumination desired may be obtained by placing the lamp farther away from or closer to the bottom of the reflector. In FIG. 2, two curves each show an illumination distribution along a diameter of the luminous spot produced by the lamp/reflector assembly.

For a given position of the lamp on the reflector axis, a narrow or "peaky" beam is obtained corresponding to the curve referenced P: it should be as narrow as possible. It is not possible to obtain a sufficiently narrow distribution with certain filament arrangements.

For another position of the lamp on the reflector axis, a wider or "flat" beam is obtained corresponding to the curve referenced F: for this beam it is desired that it should be homogeneous: the curve should be as flat as possible in its central region. Some filament arrangements lead to non-homogeneous distributions of the kind as indicated with a dotted line.

Figure 3:
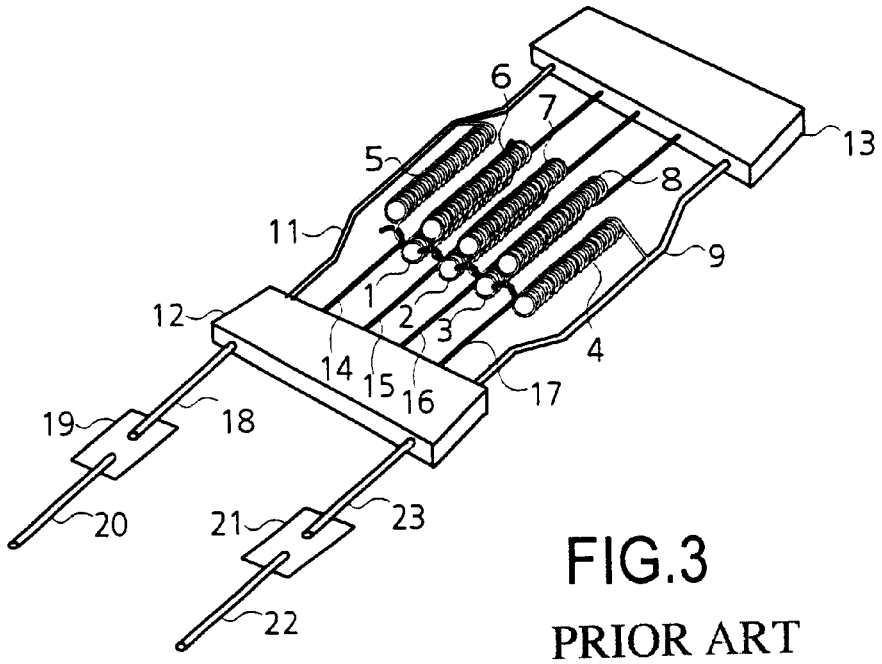
FIG.3 PRIOR ART
FIG. 3 is a perspective view of a filament and its mounting, without the glass bulb of the lamp.

The mounting arrangement of FIG. 3 serves to position filament segments, each consisting of a straight spiraled section, so as to be mutually parallel and arranged in two planes. The whole filament is coiled with a single tungsten wire which is used to coil the filament segments one after the other, without the wire being cut off between two consecutive filament segments, with the result that a wire loop is present each time between one filament segment and the next. The lower layer comprises four filament segments 1, 2, 3, 4, and the upper layer comprises four filament segments 5, 6, 7, 8. Hooks are inserted into a quartz block 12. The hook 14 supports the wire loop which connects the segment 5 to the segment 1, the hook 15 supports the wire loop which connects the segment 6 to the segment 2, etc. Two support rods 11 and 9 retain a second quartz block 13 in which hooks are inserted which support the connecting loops between the segments 3 and 8, 2 and 7, 1 and 6. The ends of the filament, formed by the upper and the right-hand portion of the segments 5 and 4, respectively, are attached and electrically connected to the respective support rods 11 and 9. The extensions 18 and 23 of the latter are connected to outer current leads 20 and 22 in known manner, via molybdenum foils 19 and 21.

Figure 4:
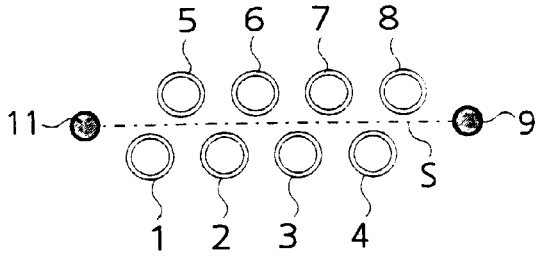
FIG.4 PRIOR ART
FIG. 4 is a cross-section through the center of a filament according to the prior art, consisting of a plurality of filament segments.

The prior-art filament of FIG. 4 is formed by a first planar layer of filament segments 1, 2, 3, 4, and a second planar layer of filament segments 5, 6, 7, 8, said two layers being symmetrical with respect to a plane of symmetry S. The elements 11 and 9 are support rods as mentioned above with reference to FIG. 3. The filament segments of one layer are arranged so as to be staggered with respect to those of the other layer.

Figure 5A:
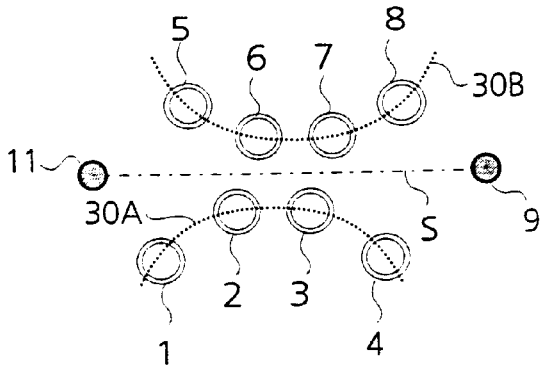
FIGS. 5A and 5B are ross-sections through the center of filaments according to the invention, each formed by a plurality of filament segments.

A filament according to the invention shown in FIG. 5A is also formed by a first layer of filament segments 1, 2, 3, 4, and a second layer of filament segments 5, 6, 7, 8. The straight coiled segments of one layer are arranged along curved involute surfaces, sections of which are referenced 30A and 30B. The two involute surfaces each form part of a cylinder whose generatrices are perpendicular to the plane of drawing. These two involute surfaces are symmetrical with respect to a plane of symmetry S, possibly with a slight lateral shift: here the surface on which the segments 5 to 8 are placed is a little farther to the right than that on which the segments 1 to 4 are placed. The convex shapes of the two involute surfaces face towards the plane of symmetry S: the two filament segments placed at the lateral ends of each layer are farther removed from the plane of symmetry than those placed in the center. The filament segments of one layer are arranged staggered with respect to those of the other layer.

Figure 5B:
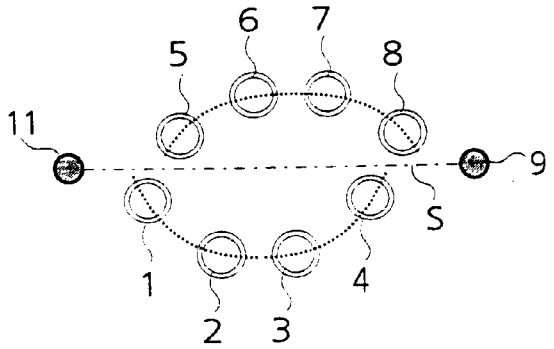

In another filament according to the invention as shown in FIG. 5B, the filament segments of the two layers, symmetrical with respect to the plane of symmetry S, are arranged along surfaces similar to those of FIG. 5A, again substantially symmetrical with respect to the plane of symmetry S, but now the concave side is turned towards the plane of symmetry S: the two filament segments placed at the center of the layer are farther removed from the plane of symmetry than those placed at the lateral ends. The filament segments of one layer are arranged staggered with respect to those of the other layer.

These arrangements render it possible to obtain a luminous spot which is better adapted in either case: for a narrow beam or a flat beam.

To obtain such a geometry, the loops between consecutive filament segments must have different lengths and must each be adapted to the distance between the two segments in question of a filament. A loop must have a radius of curvature which is as great as possible.

It should be obvious that the verb "comprise" does not exclude the presence of other elements or steps besides those listed in any claim.

What is claimed is:

1. An incandescent lamp comprising a filament formed by a plurality of filament segments, each segment including a spiral section, said segments being mutually parallel and arranged in layers, wherein the filament segments of a layer are disposed along a virtual curved surface within a layer of filament segments.

2. An incandescent lamp as claimed in claim 1, wherein it comprises a first layer of filament segments arranged along a first curved surface and a second layer of filament segments arranged along a second curved surface.

3. An incandescent lamp as claimed in claim 2, wherein the two curved surfaces are substantially symmetrical with respect to a plane.

4. An incandescent lamp as claimed in claim 2, wherein the filament segments of one layer are arranged so as to be staggered with respect to those of the other layer, each on one of the two curved surfaces.

5. An incandescent lamp as claimed in claim 2, wherein the two curved surfaces are arranged on one side and on the other side of a virtual plane and have a concavity facing towards said plane.

6. An incandescent lamp as claimed in claim 2, wherein the two curved surfaces are arranged on one side and on the other side of a virtual plane and have a convexity facing towards said plane.

7. An incandescent lamp as claimed in claim 2, wherein it comprises two layers of four filament segments each, and in that the two filament segments placed at the lateral end of each layer are closer to those of the other layer than the filament segments at the center of the layer.

8. An incandescent lamp as claimed in claim 2, wherein it comprises two layers of four filament segments each, and in that the two filament segments placed at the center of each layer are closer to those of the other layer than the filament segments placed at the lateral ends.

9. A filament for an incandescent lamp comprising a plurality of filament segments, each said segment being provided with a spiral section, said segments being parallel to each other and arranged in at least one layer, wherein ends of the spiral sections of the filaments of said at least one layer are disposed along a curve.

10. The filament claimed in claim 9, comprising first and second layers wherein ends of the first layer of filament segments are arranged along a first curve and ends of the second layer of filament segments are arranged along a second curve.

11. The filament claimed in claim 10, wherein the first and second curves are substantially symmetrical with respect to a plane.

12. The filament claimed in claim 10, wherein the filament segments of one layer are arranged so as to be staggered with respect to those of the other layer, each on one of the first and second curves.

13. The filament claimed in claim 10, wherein the first and second curves are arranged one on one side and one on the other side of a virtual plane and are concave facing towards said plane.

14. The filament claimed in claim 10, wherein the first and second curves are arranged one on one side and one on the other side of a virtual plane and are convex facing towards said plane.

15. The filament claimed in claim 10, wherein the first and second layers are each provided with four filament segments, the two filament segments at opposite ends of each first or second layer being closer to a filament segment of the other layer than to the filament segments at the center of said each first or second layer.

16. The filament claimed in claim 10, wherein the first and second layers are each provided with four filament segments, the two filament segments placed at the center of each first or second layer being closer to the two filament segments placed at the center of the other layer than the filament segment at an end of each said first or second layer is to a filament segment in the other layer opposite said filament segment at an end of each said first or second layer.

* * * * *